United States Patent [19]

Ramsey

[11] Patent Number: 4,624,509

[45] Date of Patent: Nov. 25, 1986

[54] STORAGE DRAWER

[75] Inventor: Roger H. Ramsey, Wadsworth, Ohio

[73] Assignee: Myers Industries, Akron, Ohio

[21] Appl. No.: 540,333

[22] Filed: Oct. 11, 1983

[51] Int. Cl.[4] ..... A47B 88/00

[52] U.S. Cl. ..... 312/234.5; 40/325; 312/122; 312/234; 312/330 R

[58] Field of Search ..... 40/325; 312/117, 330 R, 312/350, 122, 234, 234.1, 234.2, 234.3, 234.4, 234.5, 126

[56] References Cited

U.S. PATENT DOCUMENTS

| | | | |
|---|---|---|---|
| 243,443 | 6/1881 | Gould | 312/122 X |
| 535,462 | 3/1895 | Richter | 40/325 |
| 1,653,530 | 12/1927 | Abrachinsky | 312/122 X |
| 2,964,371 | 12/1960 | Todd et al. | 312/234.5 |
| 2,998,128 | 8/1961 | Larson | 312/350 X |
| 3,300,887 | 1/1967 | Cafiero | 312/234.3 X |
| 3,527,515 | 9/1970 | Grau et al. | 312/234.5 X |
| 3,604,775 | 9/1971 | Anderson | 312/330 R |
| 3,722,975 | 3/1973 | Taylor | 312/348 |
| 3,819,109 | 6/1974 | Ucciardino | 312/234.3 X |
| 4,231,626 | 11/1980 | Amtmann et al. | 312/350 |
| 4,433,883 | 2/1984 | Boender et al. | 312/234.3 X |

FOREIGN PATENT DOCUMENTS

| | | | |
|---|---|---|---|
| 24494 | 9/1935 | Australia | 312/126 |
| 788368 | 6/1968 | Canada | 312/234.4 |
| 2603547 | 5/1976 | Fed. Rep. of Germany | 312/117 |
| 69826 | 12/1945 | Norway | 312/122 |
| 590033 | 7/1977 | Switzerland | 312/117 |

*Primary Examiner*—Francis K. Zugel
*Assistant Examiner*—Thomas A. Rendos
*Attorney, Agent, or Firm*—Oldham, Oldham & Weber, Co.

[57] ABSTRACT

An open top storage drawer having a storage compartment formed by front, back, side and bottom walls molded integrally of plastic. An undercut is formed in a lower portion of the front wall to provide a handle for slidably removing the drawer from a storage space. A pair of offset, vertically spaced U-shaped slots are formed on the front wall. The upper slot defines a window for viewing the interior of the storage compartment, and preferably supports a transparent panel to enclose the front of the drawer. A content identifying label is mounted in the lower slot in juxtaposition with a backing wall. The drawer provides both a frontal visual inspection of the drawer's contents through the window and a printed identification thereof.

1 Claim, 4 Drawing Figures

STORAGE DRAWER

TECHNICAL FIELD

The invention relates to storage drawers and particularly to a storage drawer which allows visual inspection of the goods contained inside the drawer without opening the drawer, and in which a label also may be placed on the drawer front further identifying the stored goods.

BACKGROUND ART

Numerous types of storage drawers have been constructed in which labels are placed on the front of the drawer to identify the contents of the drawer. Also, drawers have been constructed of transparent material such as plastic which enables the contents of the drawer to be visible through the clear material. Examples of prior art patents showing such drawers having label attachment means are shown in U.S. Pat. Nos. 3,527,515; 3,604,775; 3,716,283; 3,815,800; and 4,231,626. However, none of these prior art devices provide a storage drawer in which the front wall thereof is provided with a window for viewing the contents of the drawer and which also enables a label to be attached to the front of the drawer to further identify the goods contained in the drawer. The drawers shown in the patents referred to above either have a clear front for viewing the contents or a label for identifying the contents by printed indicia on the label and not by a unique combination of both features as that of the present invention.

Industrial cabinets consist of a plurality of storage drawers arranged in a matrix configuration in which a plurality of drawers are placed in vertical and horizontal rows within a main storage cabinet. Each of the drawers is adapted to hold a particular article, part, tool or the like. It is desirable that the contents of each of the individual storage drawers be readily ascertainable by an individual when viewing the front of the cabinet. Heretofore, such drawers usually had a label on the front portion thereof to identify the contents, whereas in other storage cabinets the front walls of the individual drawers are formed of clear plastic enabling the contents to be visible to an individual. However, depending on the type of material and articles stored within the drawer, a total clear plastic front may be unsatisfactory.

It is desirable for an individual to readily see the contents of the drawers in addition to having a label associated therewith which will readily identify the contents of the drawers or certain features thereof. For example, the drawers may contain various sizes of screws, bolts, nails, etc. which are readily visible by an individual. In addition the labels on the drawer fronts could indicate the particular sizes or types of the article therein which sizes and types may not be readily ascertainable by an individual even after visual inspection of its contents.

Due to the stacking and arrangement of these individual storage drawers in a main cabinet, inspection from the top of the drawer is not available nor from the sides or back thereof. Therefore, the need has existed for a storage drawer wherein the contents of the drawer is visible through the front wall in addition to a printed identifying label being mountable on the front wall.

Furthermore, drawers are provided with various types of handles for withdrawing the drawer from a storage compartment. One type being an undercut in the front wall such as shown in U.S. Pat. No. 3,300,887. Again, no one has provided a unique drawer construction providing the visibility and identification of the goods contained therein, which also includes an undercut easily graspable handle arrangement for withdrawing the drawer from a storage compartment.

DISCLOSURE OF THE INVENTION

Objectives of the invention include providing an improved storage drawer in which the front wall thereof has a pair of vertically spaced, offset U-shaped slots, the upper one of which defines a window opening and which is adapted to receive a transparent panel enabling the contents of the drawer to be viewed without removing the drawer from its storage position and without diminishing the storage capacity of the drawer; and in which a material identification label may be placed in the lower slot. Another objective is to provide such a storage drawer in which the front wall is formed with an undercut providing an easily grasped portion for manually withdrawing the drawer from its stored position thereby eliminating any projections on the front wall of the drawer which would be subject to breakage or contact by individuals or equipment.

A still further objective of the invention is to provide such a storage drawer which may be mass produced inexpensively of molded plastic material, with the panel receiving slot being integrally molded therein; in which small projecting nubs communicate with the slots to assist in retaining the transparent panel and/or identifying label in their respective slots; and in which such drawer construction can be produced relatively inexpensive, yet provide a sturdy and durable construction which achieves the advantages and features discussed above.

These objectives and advantages are obtained by the improved storage drawer construction of the invention, the general nature of which may be stated as including a plurality of walls forming a storage compartment, one of said walls being a front wall; means formed on the front wall for mounting a label on said wall; and window means formed in the front wall spaced above the label mounting means for viewing the storage compartment.

BRIEF DESCRIPTION OF THE DRAWINGS

A preferred embodiment of the invention, illustrative of the best mode in which applicant has contemplated applying the principles, is set forth in the following description and is shown in the drawings, and is particularly and distinctly pointed out and set forth in the appended claims.

Similar numerals refer to similar parts throughout the drawings.

BEST MODE FOR CARRYING OUT THE INVENTION

Figure 1:
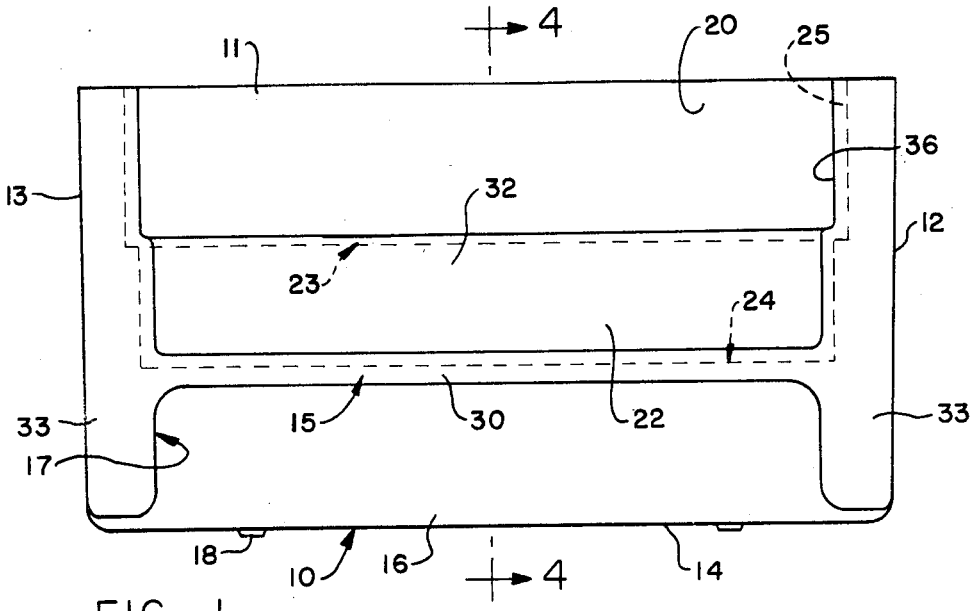
FIG. 1 is a front elevational view of the improved storage drawer construction.
Figure 4:
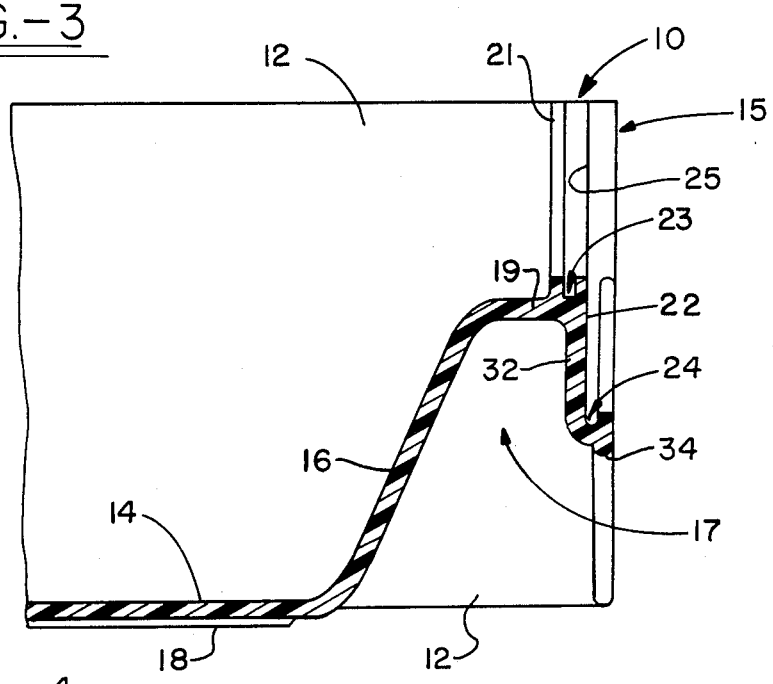
FIG. 4 is a fragmentary sectional view taken on line 4—4, FIG. 1.

FIG. 1 is a front view of the improved storage drawer indicated generally at 10, which preferably has an open top and which is molded of plastic having integrally joined back wall 11, parallel, spaced side walls 12 and 13, a bottom wall 14 and a front wall indicated generally at 15. Bottom wall 14 is joined with a portion of front wall 15 by an upwardly forwardly extending wall portion 16 which terminates with front wall 15 by a horizontally extending wall section 19 which provides an undercut handle portion 17 (FIG. 4). A pair of spaced runners or feet 18 may be molded and formed integrally on the bottom surface of bottom wall 14 to reduce the sliding friction when transferring the drawer from and into a storage area in a cabinet or the like. The drawer walls form a hollow interior or storage compartment 20 in which various items and articles can be stored.

In accordance with one of the main features of the invention, upper and lower U-shaped slots indicated generally at 23 and 24, are formed in front wall 15. Upper slot 23 includes a pair of spaced, vertically extending slot segments 25 and a horizontally extending slot segment 26. Horizontal slot segment 26 is formed at the junction of bottom wall portion 19 with a label backing wall portion 32 which forms a part of front wall 15. Lower slot 24 is offset forwardly from upper slot 23 and includes a pair of spaced, vertical slot segments 27 and a horizontal slot segment 28.

Lower slot 24 is formed by a horizontally extending strip portion 30 of front wall 15 and the back board or label supporting panel 32 which joins with undercut handle forming wall portion 19. The horizontal segments 26 and 28 of slots 23 and 24 extend generally throughout the length of front wall 15, terminating in thickened corners 33 and which extend throughout the vertical length of front wall 15.

Figure 2:
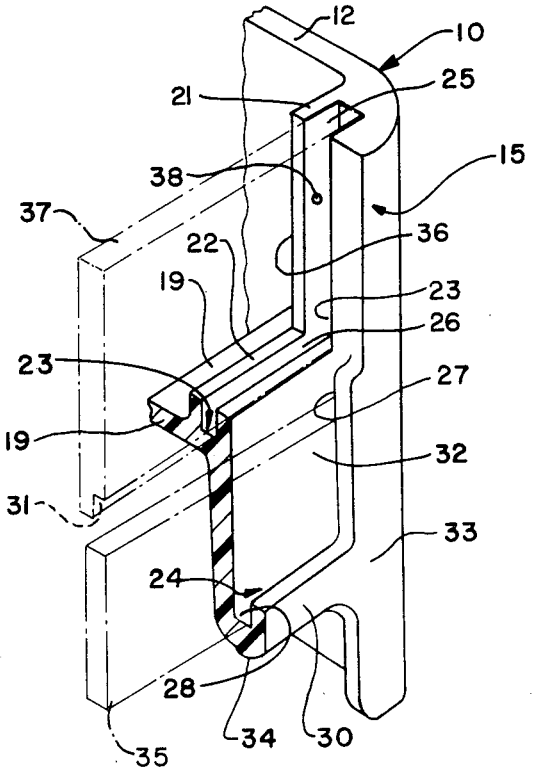
FIG. 2 is an enlarged fragmentary perspective view, with portions broken away and shown in section, of the right-hand front corner of the storage drawer.
Figure 3:
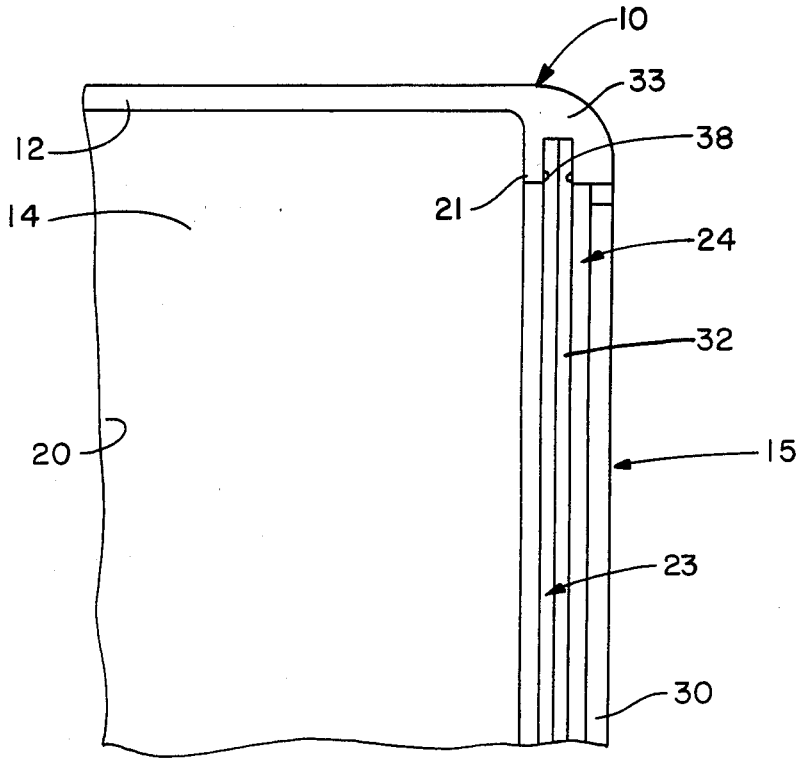
FIG. 3 is a fragmentary top plan view of the right-hand front corner of the storage drawer.

Lower slot 24 is adapted to receive an identifying label 35 shown in dot-dash lines FIG. 2, which preferably has printed indicia thereon describing the particular goods or features thereof contained in storage compartment 20. The vertical and horizontal slot forming ledges 21 and 22 which form upper slot 23 define a window 36 which enables the contents of storage compartment 20 to be readily visible from the front of the drawer. Window 36 eliminates removing the drawer from its stored position to visually ascertain the contents thereof.

Preferably a transparent panel 37 shown in dotdash lines in FIG. 2, will be slidably mounted in upper slot 23 to retain the visual effect of window 36, yet providing a continuous front wall 15 enabling large quantities of articles to be placed in storage compartment 20 without spillage through window 36. Panel 37 may be formed of glass, plastic or other transparent material. Small nubs 38 preferably are formed on vertical ledges 38 of slot 23 to assist in retaining panel 37 in position within upper slot 23. If desired, similar nubs may be formed adjacent lower slot 24 to assist in retaining a label therein.

The bottom edge 34 formed by the junction of horizontal strip 30 and label back wall 32 is curved throughout its horizontal length. This provides a convenient and safe surface adjacent undercut 17 for grasping by an individual for slidably removing drawer 10 from its storage location.

Panel 37 may have a stepped lower edge 31 which will abut against the top surface of label back wall 32 to aid in positioning panel 37 in slot 23.

It is believed that a practical improved storage drawer has been provided by the invention and that storage drawer 10 permits objects stored therein to be visually inspected readily through window 36 while enabling a conventional printed label to be mounted on the front of the drawer to provide a second type of identification for the stored articles. By having the label and window positioned in the manner shown, inspection of the goods in storage compartment 20 is readily made and also eliminates mistake of labeling and placing and removing articles therefrom.

Accordingly, the improved storage drawer construction is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved storage drawer is constructed and used, the characteristics of the construction, and the advantageous, new and useful results obtained; the new and useful structures, devices, elements, arrangements, parts, and combinations, are set forth in the appended claims.

What is claimed is:

1. A storage bin drawer including a plurality of walls including a front wall forming a storage compartment, said front wall having opposed edge portions and a continuous center panel extending between lower parts of said edge portions;

offset upper window and lower label slots formed in said front wall, said slots being open at their tops and offset longitudinally of the drawer, said window slot being longer than said label slot, and being of U-shape;

a part of said front wall forming a backing panel for said label slot; and protruding nubs formed on walls of said U-shaped slot to assist in retaining a transparent panel in said slot;

a handle means formed on a lower portion of said front wall for slidably removing the drawer from a storage position, the handle means including an undercut which is formed in a lower portion of the front wall and by a portion of a bottom of the drawer.

* * * * *